US009791111B1

(12) United States Patent
Huang et al.

(10) Patent No.: US 9,791,111 B1
(45) Date of Patent: Oct. 17, 2017

(54) LED LIGHTING DEVICE HAVING A PROLONGED LIFE DURING HIGH TEMPERATURE OPERATION

(71) Applicant: CHICONY POWER TECHNOLOGY CO., LTD., New Taipei (TW)

(72) Inventors: Huan-Hsiang Huang, New Taipei (TW); Chuch-Hsun Lin, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 0 days.

(21) Appl. No.: 15/251,140

(22) Filed: Aug. 30, 2016

(51) Int. Cl.

| | |
|---|---|
| ***F21V 15/01*** | (2006.01) |
| ***F21V 21/30*** | (2006.01) |
| ***F21K 9/20*** | (2016.01) |
| ***F21K 9/68*** | (2016.01) |
| ***F21K 9/69*** | (2016.01) |
| ***F21V 23/00*** | (2015.01) |
| ***F21V 29/508*** | (2015.01) |
| ***F21V 17/12*** | (2006.01) |
| *F21Y 105/10* | (2016.01) |

(52) U.S. Cl.
CPC ..... *F21K 9/20* (2016.08); *F21K 9/68* (2016.08); *F21K 9/69* (2016.08); *F21V 15/01* (2013.01); *F21V 17/12* (2013.01); *F21V 23/005* (2013.01); *F21V 29/508* (2015.01); *F21Y 2105/10* (2016.08)

(58) Field of Classification Search
CPC ..... F21K 9/20; F21K 9/68; F21K 9/69; F21V 29/508; F21V 15/01; F21V 17/12; F21V 23/005; F21Y 2105/10
See application file for complete search history.

(56) References Cited

U.S. PATENT DOCUMENTS

| | | | | |
|---|---|---|---|---|
| 7,652,216 | B2 * | 1/2010 | Sharrah | H01H 13/64 200/1 B |
| 8,777,449 | B2 * | 7/2014 | Van De Ven | F21S 8/02 362/249.02 |
| 9,176,298 | B1 * | 11/2015 | Gustafson | G02B 7/028 |
| 9,285,103 | B2 * | 3/2016 | Van De Ven | F21V 15/01 |

* cited by examiner

*Primary Examiner* — Tracie Y Green
(74) *Attorney, Agent, or Firm* — Muncy, Geissler, Olds & Lowe, P.C.

(57) ABSTRACT

LED lighting device includes LED light housing including hollow outer shell with planar mounting surface defined inner top side of accommodation chamber to face toward bottom opening and reflector cup mounted accommodation chamber and defining conical reflective surface therein and carrying lens at top center thereof with light exit surface of lens facing toward bottom opening of hollow outer shell, LED light-emitting module including circuit board mounted between planar mounting surface and lens, array of LEDs arranged front side of circuit board and control circuit with driver IC and capacitor thereof respectively arranged opposing front and back sides of circuit board for converting inputted AC power into stabilized DC power for driving LEDS. This structural design effectively increases available surface area of circuit board for circuit layout and related circuit layout insulation distance, allows installation of relatively larger amount of LEDs to increase overall brightness and makes reflector cup replaceable.

12 Claims, 8 Drawing Sheets

LED LIGHTING DEVICE HAVING A PROLONGED LIFE DURING HIGH TEMPERATURE OPERATION

BACKGROUND OF THE INVENTION

1. Field of the Invention

The present invention relates to LED lighting technology and more particularly, to a LED lighting device, which comprises a LED light housing consisting of a hollow outer shell, a reflector cup and a lens, and a LED light-emitting module having light-emitting diodes and a control circuit carried on a circuit board thereof, wherein the light-emitting diodes and a driver IC of the control circuit are arranged on a front side of the circuit board and a capacitor of the control circuit is arranged on an opposing back side of the circuit board, and thus, the surface area of the circuit board for circuit layout and the related circuit layout insulation distance are maximized.

2. Description of the Related Art

Lamps play a very important role in our daily life, and can provide bright illumination and clear visibility, allowing night activities to be carried out smoothly. In addition to indoor lighting, lamps can also be used for outdoor lighting, vehicle lighting as well as advertising lighting. However, conventional lamp bulb ort lamp tube type lighting devices have the drawbacks of quick light attenuation, high power consumption, large amount of waste heat and short lifespan. In order to reduce power consumption, power-saving lamp tubes are created. Further, in response to the demands of energy saving and carbon reduction and for the advantages of good photoelectric conversion efficiency, low power consumption, dimmable property, small size, quick response and long lifespan, light-emitting diodes (LEDs) are used for lighting to substitute for conventional incandescent and fluorescent lamp bulbs and tubes.

Further, fluorescent lamps are most popularly used for indoor lighting. Further, downlights are widely used in shops and department stores and installed in the ceilings or light steel frames in showcases or counters, enabling the emitted light to be focused on specific locations or commodities to attract people's eyes. However, conventional downlights have high brightness and can produce a high temperature during operation, causing thermal damage to commodities, counters, surrounding upholsteries. Further, the lifespan of fluorescent lamps will be relatively reduced when working in a high temperature environment for a long time.

In order to solve the aforesaid various lighting problems, many lighting device manufacturers use light-emitting diodes in their lighting devices to substitute for conventional fluorescent lamp bulbs or tubes, and provide lighting devices with different heat dissipation designs for quick dissipation of waste heat during operation of the light-emitting diodes. FIGS. 7 and 8 illustrate a LED lighting device according to the prior art. As illustrated the LED lighting device comprises a LED light housing A, a LED light-emitting module B and an electrical module C. The LED light housing A comprises an outer shell A1, which comprises an accommodation chamber A10, a flat mounting surface A11 disposed in a top side inside the accommodation chamber A10 and an annular heat dissipation space A12 extending around the annular heat dissipation space A12, a mounting through hole A13 cut through the center of the flat mounting surface A11 and the top wall of the outer shell A1, a light transmissive bottom cover A2 covering the bottom side of the accommodation chamber A10 of the outer shell A1, and a top cover A3 capped on the top side of the outer shell A1.

The electrical module C comprises a main control circuit board C1 mounted on the top side of the outer shell A1 and covered by the top cover A3, and a power cord C11 extended from the main control circuit board C1 to the outside of the top cover A3 for connection to an external power source. The LED light-emitting module B comprises a LED circuit board B1 mounted on the flat mounting surface A11 inside the accommodation chamber A10 of the outer shell A1, an array of light-emitting diodes B2 arranged on the circuit board B1, and a power cord B11 extended from the LED circuit board B1 and inserted through the mounting through hole A13 of the outer shell A1 and then electrically coupled to the main control circuit board C1. When the light-emitting diodes B2 are electrically conducted to emit light through the light transmissive bottom cover A2 for illumination, generated waste heat is gathered in the annular heat dissipation space A12 around the flat mounting surface A11 and then transferred through the peripheral wall of the outer shell A1 to the outside open air for quick dissipation.

Further, US Environmental Protection Agency updated ENERGY STAR Lamps Specification Version 2.0 to pursue higher efficacy levels and a broader scope of the specification in terms of the types of lamps. This ENERGY STAR Lamps Specification Version 2.0 is more critical on the operation of integrated LED light source, the efficiency of no-load mode, the condition of flashing in dimming, driver on board (DOB) under SMT architecture, the use of electrolytic capacitor (E-CAP) to solve the problem of flashing and to match with TRIAC in dimming. However, because the circuit board B1 of the LED light-emitting module B of the aforesaid prior art LED lighting device is fixedly fastened to the flat mounting surface A11 of the outer shell A1 with screws, the circuit board B1 needs to provide multiple mounting through holes for the mounting of the screws. Making these mounting through holes on the circuit board B1 relatively reduces the available surface area of the circuit board B1 for circuit layout and the related circuit layout insulation distance, limiting the flexibility of the use of the overall space. Further, the power driver of the main control circuit board C1 converts AC to DC for driving the light-emitting diodes B2. The use of this design of power drive greatly increases the cost of the electrical module C. Further, the operation of the power driver of the main control circuit board C1 to step down the voltage of the inputted AC power causes a certain amount of power conversion loss. Improvements in this regard are desired.

SUMMARY OF THE INVENTION

The present invention has been accomplished under the circumstances in view. It is therefore the main object of the present invention to provide a LED lighting device, which comprises a LED light housing and a LED light-emitting module. The LED light housing comprises a hollow outer shell, a reflector cup mounted in the hollow outer shell, and a lens mounted in the reflector cup. The hollow outer shell comprises an accommodation chamber, an opening located in a bottom side thereof in communication with the accommodation chamber and the space outside the LED light housing, and a planar mounting surface located on the center of a top side of the accommodation chamber and facing toward the opening. The reflector cup is mounted in the accommodation chamber of the hollow outer shell, comprising a lens mounting hole located on the center of a closed top side thereof and a conical reflective surface defined therein and gradually increased in diameter from the lens mounting hole toward an opposing bottom open side of the reflector cup. The lens is mounted in the lens mounting hole of the reflector cup, comprising a light exit surface facing toward the conical reflective surface of the reflector cup. The LED light-emitting module comprises a circuit board mounted between the planar mounting surface of the hollow outer shell and the lens and defining a front side and an opposing back side, a plurality of light-emitting diodes arranged on a center area of the front side of the circuit board to face toward the light exit surface of the lens, a control circuit comprising a driver IC mounted in a border area at the front side of the control circuit and a capacitor mounted on the back side of the circuit board, and a power cord electrically coupled with the circuit board and the driver IC and extended out of the back side of the circuit board for connection to an external power source. This structural design effectively increases the available surface area of the circuit board for circuit layout and the related circuit layout insulation distance, enabling the light-emitting diodes, the driver IC, the capacitor and other related components to be properly arranged on the circuit board and enhancing the flexibility of the overall configuration and use of space. This structural design also allows installation of a relatively larger amount of light-emitting diodes in the center area of the front side of the circuit board, increasing the overall brightness of the light-emitting diodes. Further, the use of the driver IC with the capacitor effectively solves the problems of flashing and dimming matching with a conventional TRIAC.

Further, the detachable mounting design of the hollow outer shell and reflector cup of the LED light housing simplifies the fabrication of the hollow outer shell with one single mold, and different model designs or different sizes of reflector cups can be selectively used and assembled with the lens to match with the hollow outer shell. Thus, the invention allows mass production of the component parts of the LED lighting device. Installation of the circuit board of the LED light-emitting module between the hollow outer shell and the lens is simple, convenient and detachable. This detachable mounting design facilitates replacement and maintenance of the component parts. Further, the conical reflective surface of the reflector cup can be coated with a reflective layer of white, silver or aluminum coating, enhancing the light reflecting performance of the conical reflective surface in reflecting light to the lens toward the outside of the LED lighting device. Further, the light exit surface of the lens can be configured to provide different grain patterns to achieve different effects on light transmission.

Further, the light-emitting diodes of the LED light-emitting module are made using CSP (Chip Scale Package) technology, and integrated with the driver IC of the control circuit into the front side of the circuit board using DOB (Driver on Board) technology and, the capacitor is arranged on the back side of the circuit board. This structural design effectively increases the available surface area of the circuit board for circuit layout and the related circuit layout insulation distance, enabling the light-emitting diodes, the driver IC, the capacitor and other related components to be properly arranged on the circuit board and enhancing the flexibility of the overall configuration and use of space. This structural design also allows installation of a relatively larger amount of light-emitting diodes in the center area of the front side of the circuit board, increasing the overall brightness of the light-emitting diodes and avoiding flashing.

Further, the power cord of the LED light-emitting module circuit is electrically coupled with the circuit layout on the back side of the board and extended out of the back side of the circuit board without interfering with the circuit layout on the front side of the circuit board. Further, the back side of the circuit board is closely attached to the planar mounting surface of the hollow outer shell to create a thermal path for enabling waste thermal energy to be transferred from the circuit board to the metal hollow outer shell for quick dissipation to the outside open air during the operation of the light-emitting diodes. Waste thermal energy can also be transmitted through the annular heat dissipation space and vent hole of the hollow outer shell for heat exchange with the outside cold air, enhancing the heat dissipation efficiency of the LED light-emitting module and achieving optimal cooling and heat dissipation.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
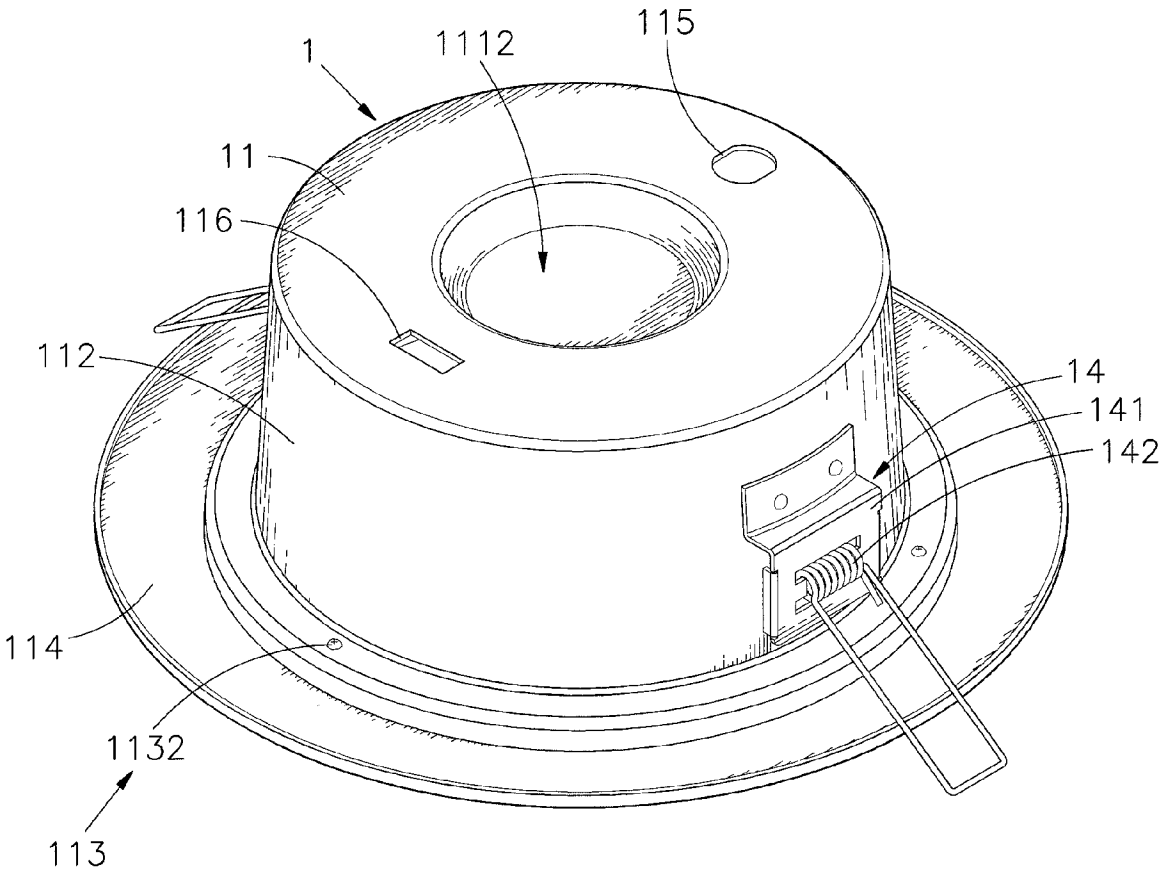
FIG. 1 is an oblique top elevational view of a LED lighting device in accordance with the present invention.
Figure 2:
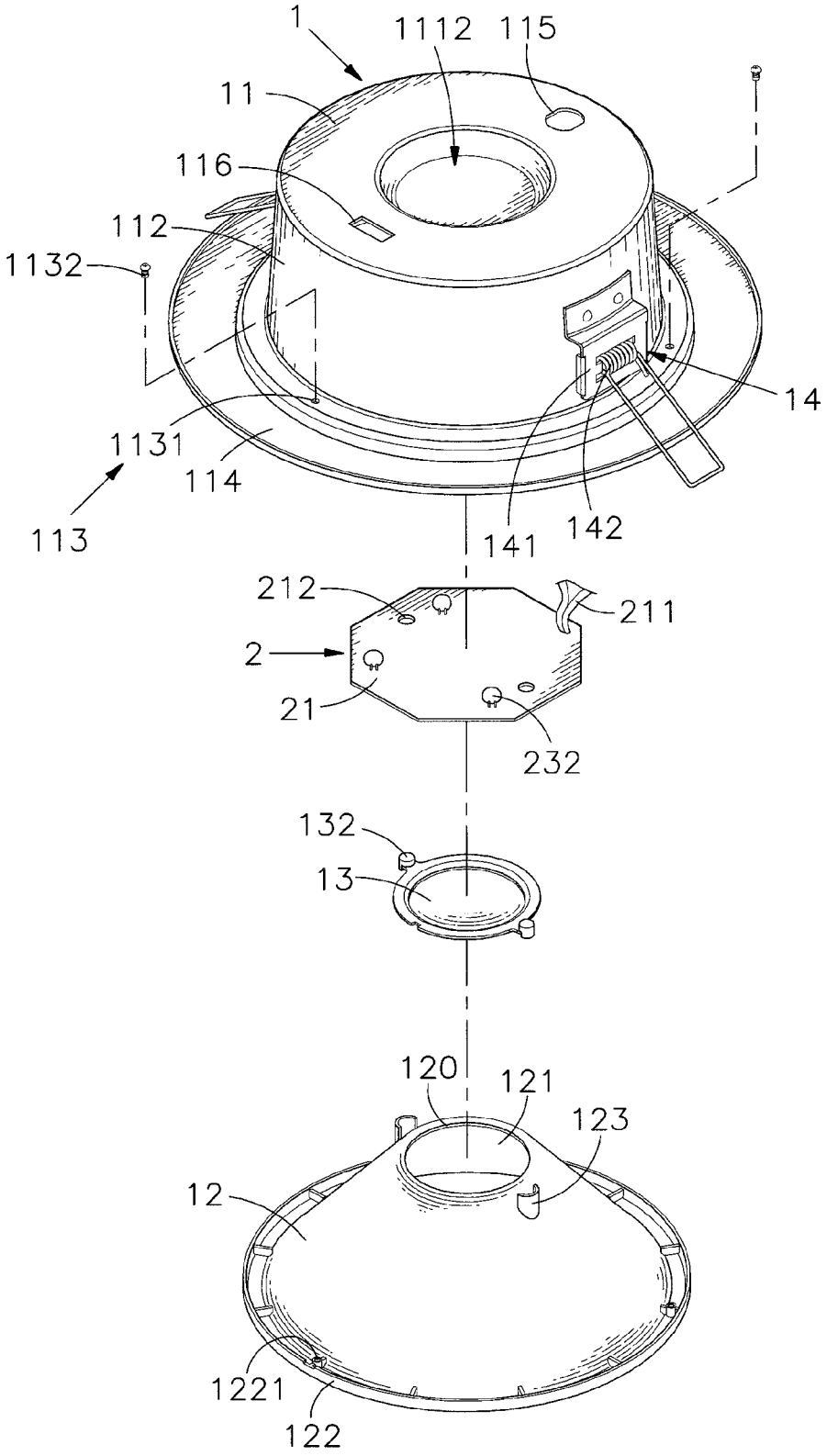
FIG. 2 is an exploded view of the LED lighting device in accordance with the present invention.
Figure 3:
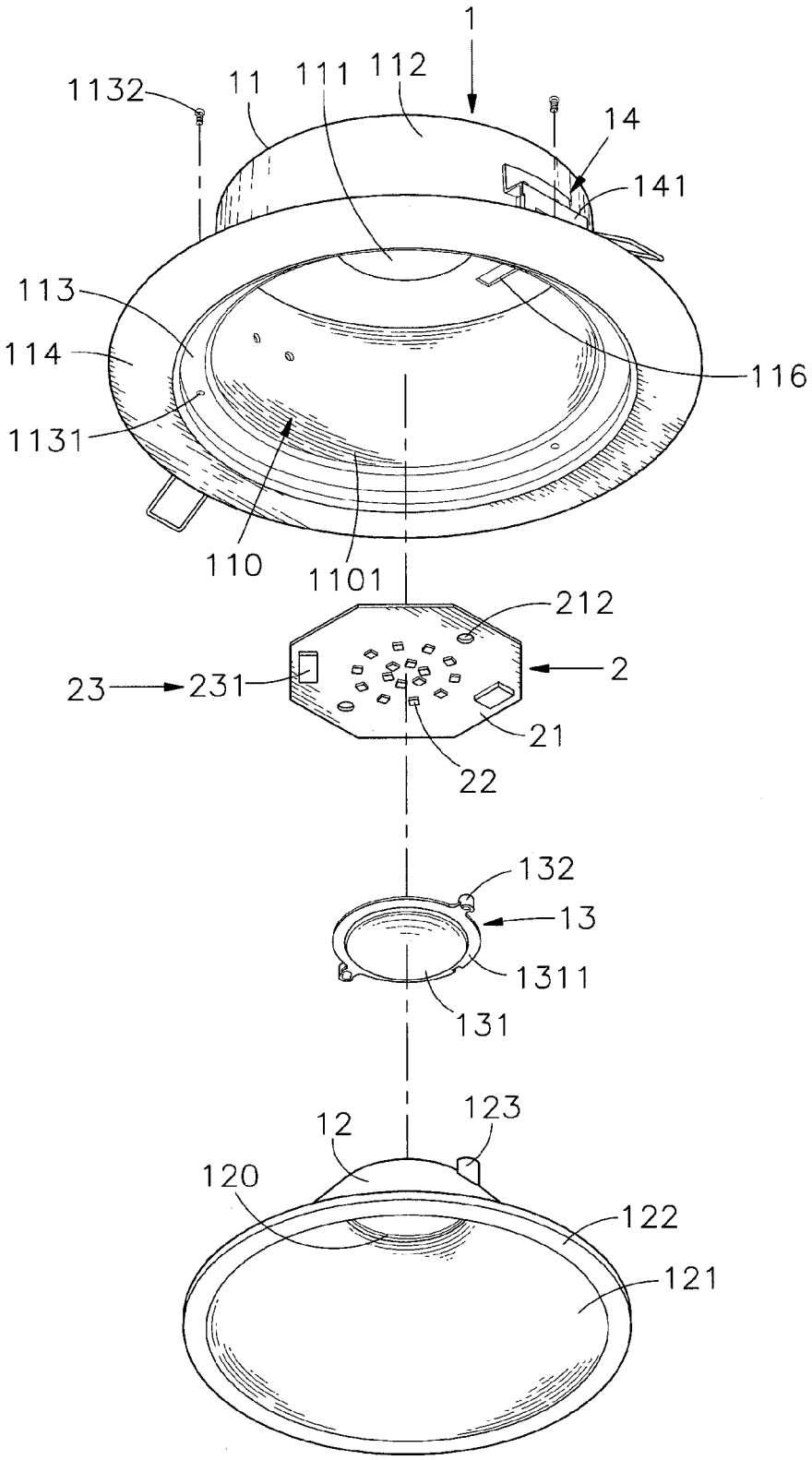
FIG. 3 corresponds to FIG. 2 when viewed from another angle.
Figure 4:
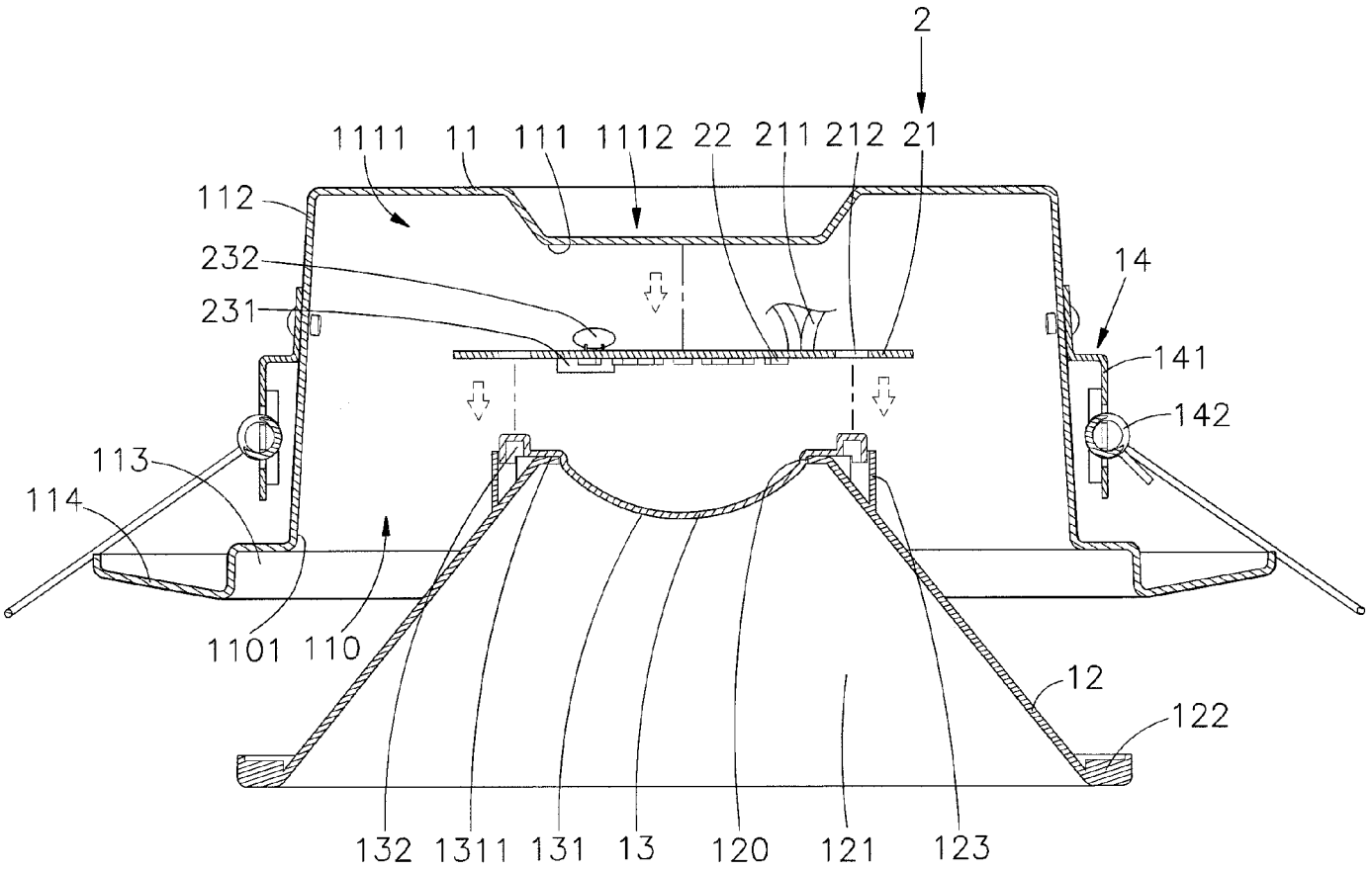
FIG. 4 is a front sectional exploded view of the LED lighting device in accordance with the present invention.
Figure 5:
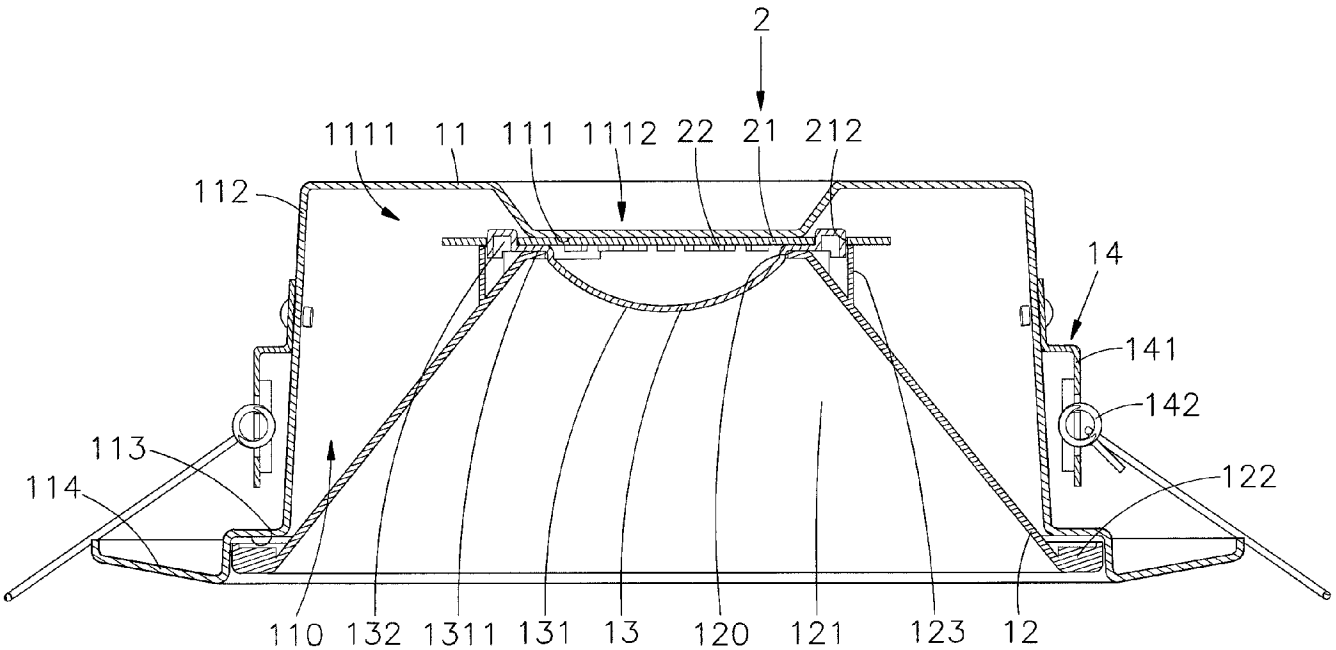
FIG. 5 is a front sectional assembly view of the LED lighting device in accordance with the present invention.
Figure 6:
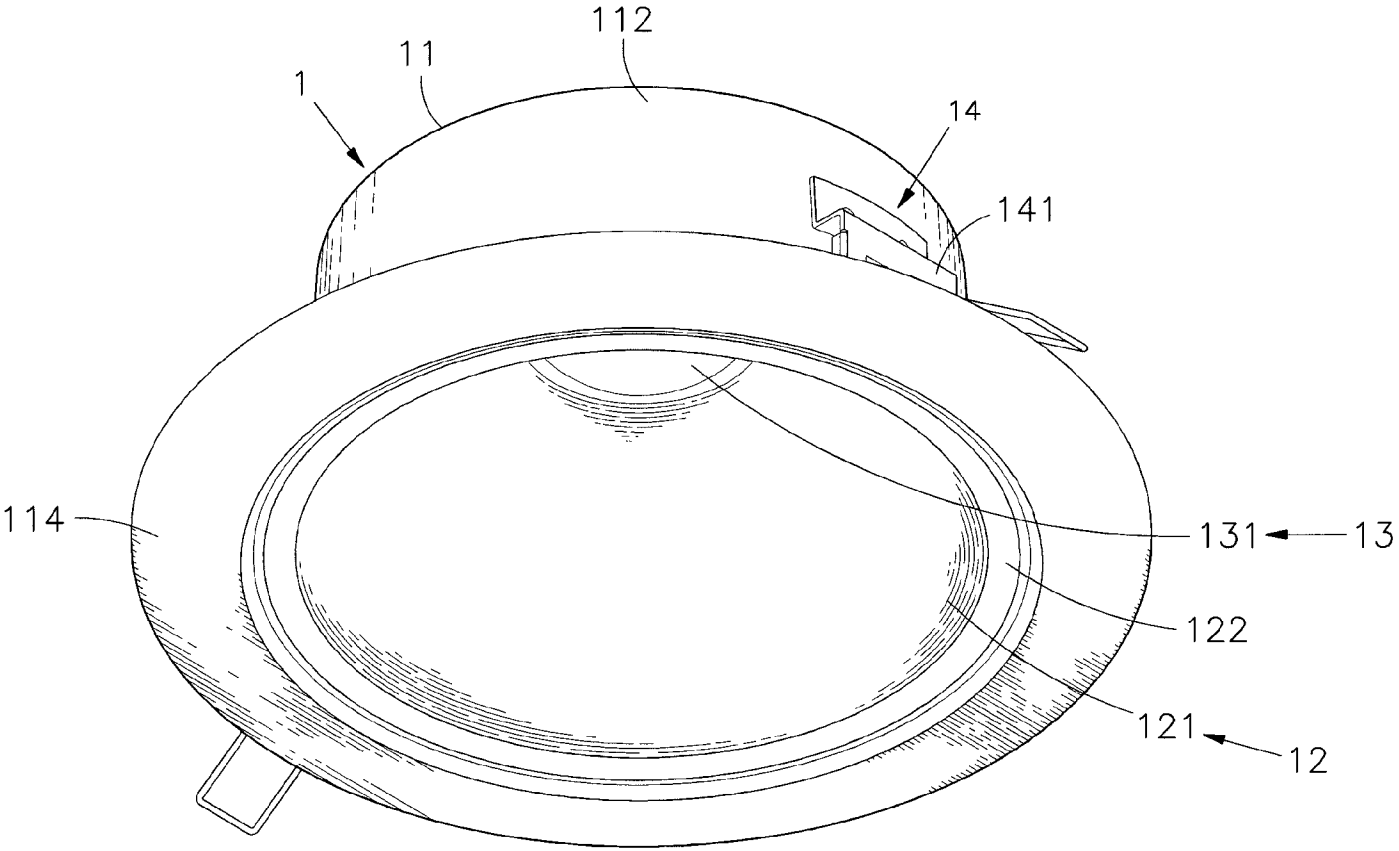
FIG. 6 is an oblique bottom elevational view of the LED lighting device in accordance with the present invention.
Figure 7:
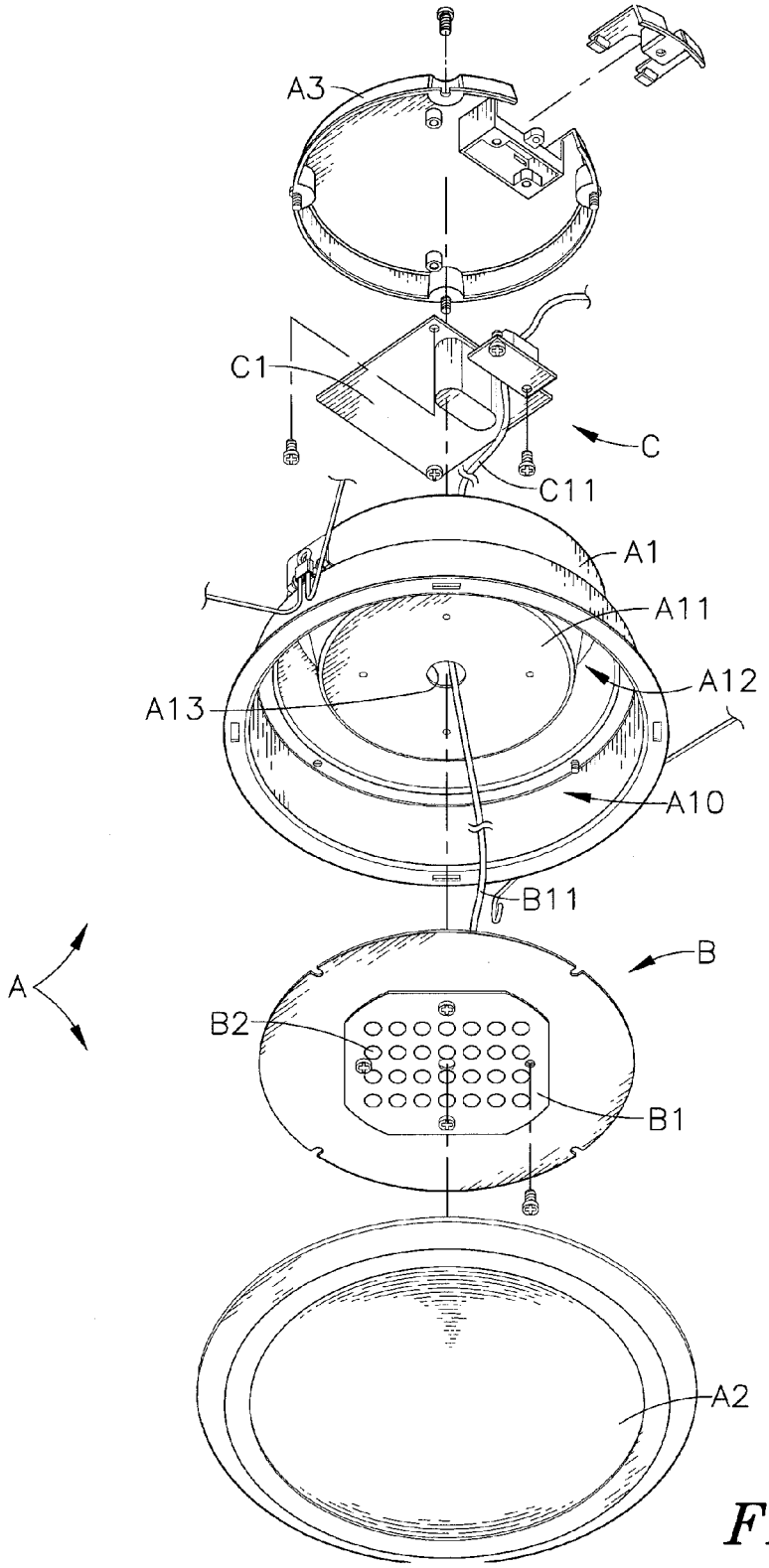
FIG. 7 is an exploded view of a lighting device according to the prior art.
Figure 8:
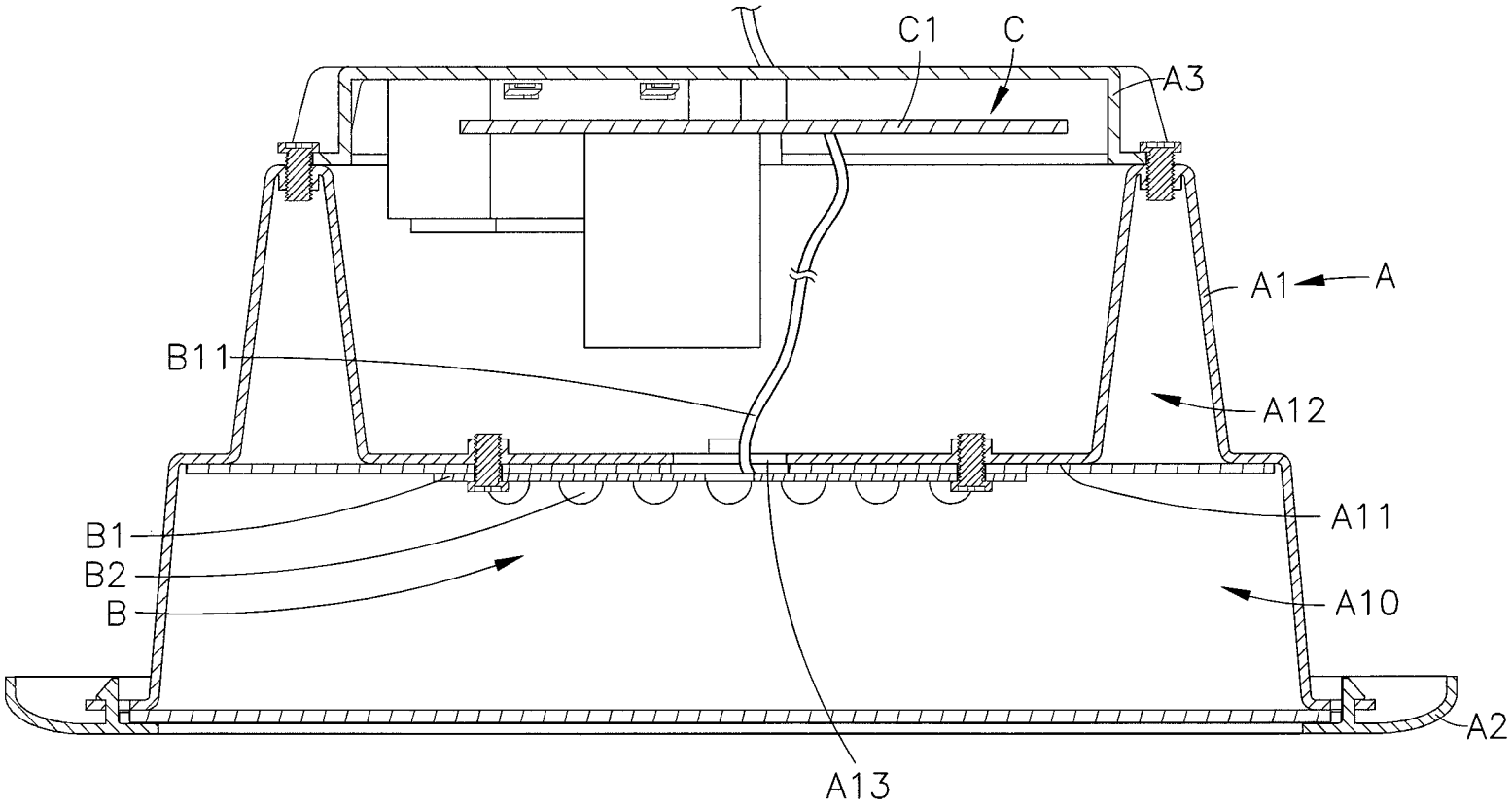
FIG. 8 is a front sectional views of the lighting device according to the prior art.

Referring to FIGS. 1-6, an oblique top elevational view of a LED lighting device in accordance with the present invention, an exploded view of the LED lighting device, another exploded view of the LED lighting device, a front sectional exploded view of the LED lighting device and a front sectional assembly view of the LED lighting device are shown. As illustrated, the LED lighting device comprises a LED light housing 1 and a LED light-emitting module 2.

The LED light housing 1 comprises a hollow outer shell 11, a reflector cup 12, a lens 13, and a plurality of mounting devices 14. The hollow outer shell 11 comprises an accommodation chamber 110, an opening 1101 located in a bottom side thereof in communication with the accommodation chamber 110 and the outside space, a planar mounting surface 111 located on the center of a top side of the accommodation chamber 110 and facing toward the opening 1101, an annular heat dissipation space 1111 defined in the accommodation chamber 110 around the planar mounting surface 111, a top recess 1112 located on the center of a top wall thereof opposing to the planar mounting surface 111, an upright peripheral wall 112 extending around the accommodation chamber 110, a locating groove 113 extending around a bottom side of the accommodation chamber 110 in communication with the opening 1101, an annular rim 114 extended radially outwardly from a stepped bottom side of the upright peripheral wall 112, a plurality of mounting through holes 1131 vertically and equiangularly cut through the stepped bottom side of the upright peripheral wall 112 and the locating groove 113 for the mounting of respective screws 1132, and at least one wire lead-out hole 115 and at least one vent hole 116 cut through a top wall thereof around the top recess 1112 and the planar mounting surface 111 in communication with the annular heat dissipation space 1111.

The reflector cup 12 is mounted in the accommodation chamber 110 of the hollow outer shell 11, comprising a lens mounting hole 120 located on the center of a closed top side thereof, a conical reflective surface 121 defined therein and gradually increased in diameter from the lens mounting hole 120 toward an opposing bottom open side of the reflector cup 12, a locating flange 122 radially outwardly extended from a bottom side of the conical reflective surface 121 for positioning in the locating groove 113 of the hollow outer shell 11, a plurality of female screws 1221 upwardly extended from the locating flange 122 in an equiangularly spaced manner for the mounting of the respective screws 1132, and a plurality of hollow columns 123 upwardly extended from the periphery thereof and symmetrically and equiangularly spaced around the lens mounting hole 120.

The lens 13 is mounted in the lens mounting hole 120 of the reflector cup 12, comprising a light exit surface 131 that faces toward the conical reflective surface 121 of the reflector cup 12, a stepped abutment edge 1311 extended around the periphery thereof and abutted against the reflector cup 12 around the lens mounting hole 120, and a plurality of mounting rods 132 extended from the stepped abutment edge 1311 and respectively press-fitted with respective bottom ends thereof into the respective hollow columns 123.

The mounting devices 14 are equiangularly mounted around the periphery of the hollow outer shell 11, each comprising a locating plate 141 affixed to the periphery of the hollow outer shell 11 and a clamping spring 142 mounted at the locating plate 141. The clamping springs 142 of the mounting devices 14 are adapted for mating with the annular rim 114 of the hollow outer shell 11 to secure the LED light housing 1 to a mounting hole in a ceiling panel, wall panel or cabinet panel (not shown).

The hollow outer shell 11 of the LED light housing 1 is a one piece member made from metal using aluminum extrusion or electroplating technique. Radiation fins (not shown) can be formed on the outside wall of the hollow outer shell 11. The reflector cup 12 is preferably made from injection molded plastics. However, in actual application, the reflector cup 12 can be made from metal in one piece. Further, the conical reflective surface 121 of the reflector cup 12 can be coated with a layer of reflective coating using brush coating or thin-film deposition techniques (not shown). Further, the reflector cup 12 and the lens 13 are detachably fastened together, and can be made from one same material (such as plastics, glass and any other suitable optical material). Alternatively, the reflector cup 12 and the lens 13 can be made from different materials (such as metal, plastics, glass and other optical materials). In actual application, the reflector cup 12 and the lens 13 can be made in one piece from one single material (for example, thermoplastic) selected according to heat dissipation (such as thermal conductivity), light transmittance (such as percent transmittance) or light guide requirements, or the structural design.

The LED light-emitting module 2 comprises a circuit board 21 carrying a circuit layout, a plurality of light-emitting diodes 22 arranged in an array within a center area at a front side of the circuit board 21, a control circuit 23 mounted on the circuit board 21 beyond the center area and electrically coupled with the light-emitting diodes 22, a power cord 211 electrically connected to the circuit layout of the circuit board 21 and extended out of an opposing back side of the circuit board 21 for connection to an external power source (city power outlet, power supply device, indoor power supply wiring, power generator, etc.) to provide the circuit board 21, the light-emitting diodes 22 and the control circuit 23 with the necessary working voltage and a plurality of mounting holes 212 cut through the circuit board 21. The power cord 211 is directly and electrically connected to the circuit layout at the back side of the circuit board 21. Thus, the installation of the power cord 211 neither need to make any mounting through hole on the circuit board 21 nor to interfere with the circuit layout on the front side of the circuit board 21, saving much the installation cost. Further, the control circuit 23 comprises a driver IC 231 having integrated therein rectifier circuit, transformer, resistors, etc., and at least one capacitor (aluminum electrolytic capacitor or high-voltage capacitor) 232 mounted on the border area of the back side of the circuit board 21. The driver IC 231 of the control circuit 23 is adapted for converting city AC power to DC power that is then rectified and filtered through the capacitor 232 for driving the light-emitting diodes 22 to emit light.

Further, the light-emitting diodes 22 are made using CSP (Chip Scale Package) technology, and integrated with the driver IC 231 of the control circuit 23 into the circuit board 21 using DOB (Driver on Board) technology. Thus, the dimension of the LED light-emitting module 2 can be minimized. Further, the driver IC 231 converts AC to DC for driving the light-emitting diodes 22, saving the cost and improving power conversion efficiency. The combination of the driver IC 231 and the capacitor 232 can solve the problems of flashing and dimming matching with a conventional TRIAC.

In installation, place the circuit board 21 of the LED light-emitting module 2 on the lens 13 of the LED light housing 1 to force the mounting holes 212 of the circuit board 21 into engagement with the respective opposing top ends of the mounting rods 132 of the lens 13, enabling the light-emitting diodes 22 at the center area of the front side of the circuit board 21 to face toward the lens 13. Thereafter, insert the power cord 211 of the circuit board 21 through the wire lead-out hole 115 of the hollow outer shell 11 to the outside, and then cap the hollow outer shell 11 downwardly onto the reflector cup 12, to abut the planar mounting surface 111 of the hollow outer shell 11 against the back side of the circuit board 21 and to keep the capacitor 232 and the mounting rods 132 of the lens 13 in the annular heat dissipation space 1111 around the planar mounting surface 111. At this time, the locating flange 122 of the reflector cup 12 is engaged into the locating groove 113 of the hollow outer shell 11. Thereafter, insert the screws 1132 through the respective mounting through holes 1131 of the hollow outer shell 11 and thread them into the respective female screws 1221 to affix the hollow outer shell 11 and the reflector cup 12 together, enabling the circuit board 21 to be firmly secured in between the hollow outer shell 11 and the lens 13.

As stated above, the light-emitting diodes 22 of the LED light-emitting module 2 are made using CSP (Chip Scale Package) technology, and integrated with the driver IC 231 of the control circuit 23 into the front side of the circuit board 21 using DOB (Driver on Board) technology and, the capacitor 232 is arranged on the back side of the circuit board 21. This structural design effectively increases the available surface area of the circuit board 21 for circuit layout and the related circuit layout insulation distance, enabling the light-emitting diodes 22, the driver IC 231, the capacitor 232 and other related components to be properly arranged on the circuit board 21 and enhancing the flexibility of the overall configuration and use of space. This structural design also allows installation of a relatively larger amount of light-emitting diodes 22 in the center area of the front side of the circuit board 21, increasing the overall brightness of the light-emitting diodes 22. Further, the use of the driver IC 231 with the capacitor 232 effectively solves the problems of flashing and dimming matching with a conventional TRIAC.

In application, connect the power cord 211 at the circuit board 21 of the LED light-emitting module 2 to an external power source, enabling inputted AC power to be converted to DC power by the driver IC 231 of the control circuit 23 and then filtered through the capacitor 232 to provide a stabilized DC output for driving the light-emitting diodes 22, causing the light-emitting diodes 22 to emit light through the light exit surface 131 of the lens 13. Subject to the functioning of the conical reflective surface 121 of the reflector cup 12, light emitted by the light-emitting diodes 22 is concentrated onto the lens 13 to go through the light exit surface 131 of the lens 13 toward the outside for illumination, providing good lighting effects. Further, the back side of the circuit board 21 is closely attached to the planar mounting surface 111 of the hollow outer shell 11 to create a thermal path for enabling waste thermal energy to be transferred from the circuit board 21 to the metal hollow outer shell 11 for quick dissipation to the outside open air during the operation of the light-emitting diodes 22. Waste thermal energy can also be transmitted through the annular heat dissipation space 1111 and vent hole 116 of the hollow outer shell 11 for heat exchange with the outside cold air, enhancing the heat dissipation efficiency of the LED light-emitting module 2 and achieving optimal cooling and heat dissipation.

Further, the detachable mounting design of the hollow outer shell 11 and reflector cup 12 of the LED light housing 1 simplifies the fabrication of the hollow outer shell 11 with one single mold, and different model designs or different sizes of the reflector cups 12 can be selectively used and assembled with the lens 13 to match with the hollow outer shell 11. Thus, the invention allows mass production of the component parts of the LED lighting device. Installation of the circuit board 21 of the LED light-emitting module 2 between the hollow outer shell 11 and the lens 13 is simple, convenient and detachable. This detachable mounting design facilitates replacement and maintenance of the component parts. Further, the conical reflective surface 121 of the reflector cup 12 can be coated with a reflective layer of white, silver or aluminum coating, enhancing the light reflecting performance of the conical reflective surface 121 in reflecting light to the lens 13 toward the outside of the LED lighting device. Further, the light exit surface 131 of the lens 13 can be configured to provide different grain patterns to achieve different effects on light transmission.

As stated above, the planar mounting surface 111 is located at the center of the top side in the accommodation chamber 110 inside the hollow outer shell 11 of the LED light housing 1 to face downwardly toward the opening 1101; the lens 13 is located at the center of the top side of the reflector cup 12 right below the planar mounting surface 111 of the hollow outer shell 11; the circuit board 21 of the LED light-emitting module 2 is closely mounted between the planar mounting surface 111 of the hollow outer shell 11 and the lens 13; the light-emitting diodes 22 are arranged on the front side of the circuit board 21 at the center to face toward the lens 13; the driver IC 231 of the control circuit 23 is arranged on the front side of the control circuit 23 near the border area; the capacitor 232 of the control circuit 23 is arranged on the back side of the circuit board 21 near the border area. The structural design of the LED lighting device of the present invention effectively increases the available surface area of the circuit board 21 for circuit layout and the related circuit layout insulation distance, enabling the light-emitting diodes 22, the driver IC 231, the capacitor 232 and other related components to be properly arranged on the circuit board 21 and enhancing the flexibility of the overall configuration and use of space. Further, the design of the capacitor 232 of the driver IC 231 effectively solves the problems of flashing and dimming matching with a conventional TRIAC.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A LED lighting device, comprising:

a LED light housing comprising a hollow outer shell, a reflector cup mounted in said hollow outer shell and a lens mounted in said reflector cup, said hollow outer shell comprising an accommodation chamber, an opening located in a bottom side thereof in communication with said accommodation chamber and the space outside said LED light housing and a planar mounting surface located on the center of a top side of said accommodation chamber and facing toward said opening, said reflector cup being mounted in said accommodation chamber of said hollow outer shell, said reflector cup comprising a lens mounting hole located on the center of a closed top side thereof and a conical reflective surface defined therein and gradually increased in diameter from said lens mounting hole toward an opposing bottom open side of said reflector cup, said lens being mounted in said lens mounting hole of said reflector cup, said lens comprising a light exit surface facing toward said conical reflective surface of said reflector cup; and a LED light-emitting module comprising a circuit board mounted between said planar mounting surface of said hollow outer shell and said lens and defining a front side and an opposing back side, a plurality of light-emitting diodes arranged on a center area of the said front side of said circuit board to face toward said light exit surface of said lens, a control circuit installed in said circuit board, said control circuit comprising a driver IC mounted in a border area at the said front side of said control circuit and a capacitor mounted on the said back side of said circuit board, and a power cord electrically coupled with said circuit board and said driver IC and extended out of the said back side of said circuit board for connection to an external power source.

2. The LED lighting device as claimed in claim 1, wherein said hollow outer shell of said LED light housing further comprises an annular heat dissipation space defined in said accommodation chamber around said planar mounting surface, a top recess located on the center of a top wall thereof opposing to said planar mounting surface, and at least one wire lead-out hole and at least one vent hole cut through a top wall thereof around said top recess and said planar mounting surface in communication with said annular heat dissipation space; said power cord of said LED light-emitting module is inserted through said at least one wire lead-out hole to the outside of said LED light housing; said capacitor of said control circuit is suspended in said annular heat dissipation space.

3. The LED lighting device as claimed in claim 1, wherein said hollow outer shell of said LED light housing comprises an upright peripheral wall extending around said accommodation chamber, a locating groove extending around a bottom side of said accommodation chamber in communication with said opening, and an annular rim extended radially outwardly from a stepped bottom side of said upright peripheral wall; said reflector cup further comprises a locating flange radially outwardly extended from a bottom side of said conical reflective surface for positioning in said locating groove of said hollow outer shell.

4. The LED lighting device as claimed in claim 3, wherein said hollow outer shell further comprises a plurality of mounting through holes vertically and equiangularly cut through said stepped bottom side of said upright peripheral wall and said locating groove, and a plurality of screws respectively mounted in said mounting through holes; said reflector cup further comprises a plurality of female screws upwardly extended from said locating flange in an equiangularly spaced manner and respectively fastened up with the respective said screws to affix said reflector cup to said hollow outer shell and to abut said lens at said circuit board against said planar mounting surface.

5. The LED lighting device as claimed in claim 3, wherein said hollow outer shell further comprises a plurality of mounting devices spaced around the said upright peripheral wall, each said mounting device comprising a locating plate fixedly mounted on said hollow outer shell, and a clamping spring mounted at said locating plate for mating with said annular rim of said hollow outer shell to secure said LED light housing to an external mounting hole.

6. The LED lighting device as claimed in claim 1, wherein said reflector cup of said LED light housing further comprises a plurality of hollow columns upwardly extended from the periphery thereof and symmetrically and equiangularly spaced around said lens mounting hole; said lens further comprises a stepped abutment edge extended around the periphery thereof and abutted against said reflector cup around said lens mounting hole, and a plurality of mounting rods extended from said stepped abutment edge and respectively press-fitted with respective bottom ends thereof into the respective said hollow columns of said reflector cup; said circuit board of said LED light-emitting module comprises a plurality of mounting holes respectively forced into engagement with respective opposing top ends of said mounting rods of said lens.

7. The LED lighting device as claimed in claim 1, wherein said lens of said LED light housing comprises a plurality of mounting rods spaced around the border thereof; said circuit board of said LED light-emitting module comprises a plurality of mounting holes respectively forced into engagement with said mounting rods of said lens.

8. The LED lighting device as claimed in claim 1, wherein said hollow outer shell of said LED light housing is made from metal in one piece.

9. The LED lighting device as claimed in claim 1, wherein said reflector cup and said lens of said LED light housing are made from thermoplastics in one piece.

10. The LED lighting device as claimed in claim 1, wherein said reflector cup and said lens of said LED light housing are respectively made from thermoplastics and glass.

11. The LED lighting device as claimed in claim 1, wherein said reflector cup of said LED light housing is selectively made from the material group of metal, plastics and glass; said lens of said LED light housing is selectively made from the material group of plastics and glass.

12. The LED lighting device as claimed in claim 1, wherein said light-emitting diodes of said LED light-emitting module are made using CSP (Chip Scale Package) technology, and integrated with said driver IC of said control circuit into said circuit board using DOB (Driver on Board) technology.

* * * * *